US005828628A

United States Patent [19]

Born et al.

[11] Patent Number: 5,828,628

[45] Date of Patent: Oct. 27, 1998

[54] TIMEPIECE COMPRISING A MECHANISM DRIVEN BY MECHANICAL DRIVING MEANS AND A POWER RESERVE INDICATING DEVICE

[75] Inventors: Jean-Jacques Born, Morges; Raymond Froidevaux, Boudry, both of Switzerland

[73] Assignee: Asulab S.A., Bienne, Switzerland

[21] Appl. No.: 992,696

[22] Filed: Dec. 17, 1997

[30] Foreign Application Priority Data

Dec. 19, 1996 [CH] Switzerland ..... 3114/96

[51] Int. Cl.[6] ..... G04B 9/00; G04B 1/10; G04B 1/00

[52] U.S. Cl. ..... 368/66; 368/140; 368/203

[58] Field of Search ..... 368/66, 140, 155, 368/203, 204

[56] References Cited

U.S. PATENT DOCUMENTS 5,446,902 8/1995 Mossuz et al. ..... 368/66
5,699,322 12/1997 Born ..... 368/66
5,751,666 5/1998 Farine et al. ..... 368/140

FOREIGN PATENT DOCUMENTS 384015 4/1908 France .
405768 1/1910 France .
281801 3/1952 Switzerland .

*Primary Examiner*—Vit W. Miska
*Attorney, Agent, or Firm*—Sughrue, Mion, Zinn, Macpeak & Seas, PLLC

[57] ABSTRACT

Timepiece comprising a mechanical movement which includes a barrel (8) driving a mechanism formed by a gear train, said timepiece comprising a device for indicating the power reserve comprising a resilient element (6) rotatively coupling in a mechanical manner two coaxial wheels (2,4) of said gear train and a disk (4) and a hand (42) rotatively coupled to said two coaxial wheels respectively and arranged so as to indicate an angular displacement between said hand (42) and a reference mark associated to said disk (40) for indicating the moment of force exerted by said barrel on said gear train, said moment of force being representative of the power reserve of the timepiece.

10 Claims, 6 Drawing Sheets

TIMEPIECE COMPRISING A MECHANISM DRIVEN BY MECHANICAL DRIVING MEANS AND A POWER RESERVE INDICATING DEVICE

The present invention concerns a timepiece including a mechanism driven by mechanical means and a power reserve indicating device for this mechanism.

Horological mechanical timepieces have been provided with power reserve indicating devices for a long time. These power reserve indicating devices indicate the winding level of the driving spring, also called the mainspring or barrel for reasons of simplification. The winding level of the mainspring corresponds to the amount of tension of this spring and thus to a given power reserve of the mechanism driven by the barrel.

The known power reserve indicating devices are all relatively complex and require, in particular, the addition of cumbersome elements. A conventional power reserve indicating device is formed of a gear train used for reducing the rotative path of the barrel so that an indicator driven by said gear train rotates by an angle less than 360° between the maximum winding position and the minimum winding position of the mainspring. A gear train of this type thus normally requires several wheels which increase the space requirement of the movement and make its design more complicated. Therefore, arranging a conventional power reserve indicating device in a horological mechanical movement is relatively expensive and the resulting space requirement of such a device leads to design difficulties which can not always be overcome, in particular with movements of small dimensions, for example for ladies' wristwatches movements.

An object of the present invention is to overcome the drawbacks of the prior art by providing a timepiece comprising a power reserve indicating device which does not require much space and which may be easily integrated into any mechanical horological movement. Another object of the invention is to provide a power reserve indicating device which is inexpensive and easy to manufacture.

The present invention thus concerns a timepiece including a barrel, used for storing mechanical energy for driving a mechanism, and a device for indicating the power reserve of said mechanism, characterised in that said power reserve indicating device comprises a resilient element rotatively coupling in a mechanical manner first and second wheels rotatively driven by said barrel about a common geometric axis, and first and second display means rotatively coupled to said first and second wheels respectively and arranged so as to indicate an angular displacement between two directions determined respectively by said first and second display means, at least within a determined range of values of said angular displacement.

As a result of the characteristics of the invention, an indication of the winding level of the barrel, i.e. the amount of tension of the mainspring or the moment of force exerted by the barrel on the mechanism gear train is directly displayed so that a user may know the power reserve of the timepiece. In an embodiment which will be described hereinafter, it will be noted that the indication of the power reserve requires a very limited number of additional elements and in particular no additional wheels.

An univoque moment of force exerted by the barrel on the gear train driven by this barrel corresponds to each winding level of the mainspring. Thus, the indication of the moment of force exerted by the barrel on the driven mechanism, in particular on the gear train, gives a perfectly defined and univoque indication of the winding level of the mainspring.

In a particular embodiment, means for limiting the angular displacement between the first and second display means so as to limit upwards and/or downwards the moment of force exerted on the resilient element of the power reserve indicating device of the invention are provided.

Particular features and other advantages of the present invention will be described hereinafter with the aid of the following description made in connection with the attached drawings, given by way of non-limiting example, in which:

FIG. 1 is a cross-section of a first embodiment of a power reserve indicating device of the invention;

FIGS. 2*a*, 2*b* and 2*c* are partial top views at the level of line II—II of FIG. 1 representing respectively three different positions corresponding to different winding levels of the mainspring fitting the horological mechanical movement shown in FIG. 1;

Figure 1:
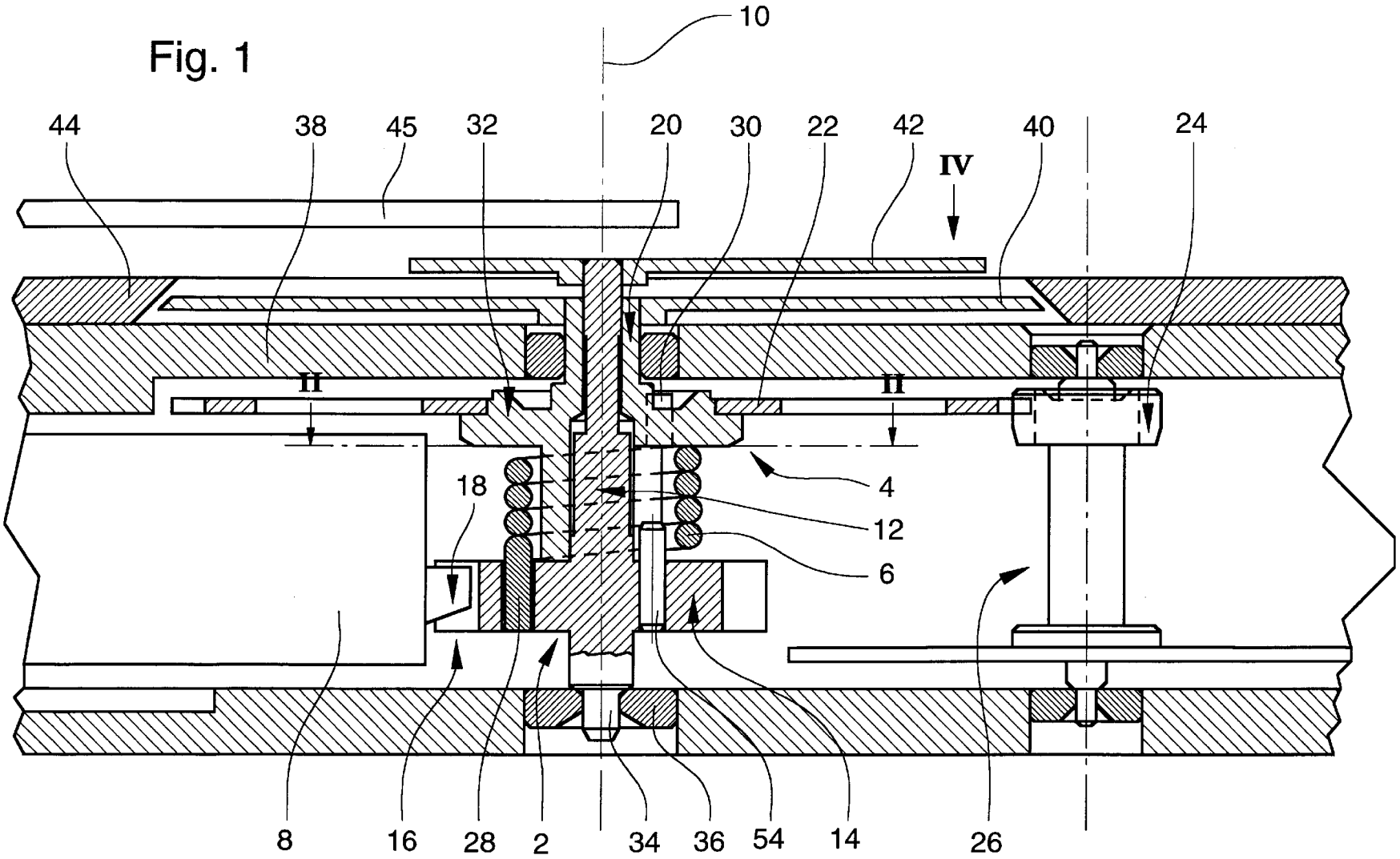

Referring to FIGS. 1 to 4, a first embodiment of a mechanical timepiece including a power reserve indicating device according to the invention will be described.

The power reserve indicating device includes a first wheel 2 and a second wheel 4 rotatively coupled in a mechanical manner by a helical spring 6 which resiliently couples wheels 2 and 4. Wheels 2 and 4 are arranged coaxially so as to be rotatively driven by a barrel 10 about a common geometric axis 10. Wheel 2 comprises a central shaft 12 and a pinion 14 the toothing of which engages directly with the toothing 18 of the barrel 8. Wheel 4 comprises a cylindrical part 20 and a toothed wheel 22. Toothed wheel 22 engages with pinion 24 of a wheel 26.

Cylindrical part 20 of wheel 4 is mounted onto shaft 12 of wheel 2 so as to be able rotate about geometric axis 10 independently of the rotation of wheel 2. However, according to the invention, wheel 2 is resiliently and rotatively coupled to wheel 4 by means of spring 6. In order to do this, the first end 28 of spring 6 is fastened to wheel 2 while the second end 30 of spring 6 is fastened to wheel 4. The fastening of spring 6 to wheels 2 and 4 may be achieved in various ways within reach of the man skilled in the art and in particular, as shown, by inserting ends 28 and 30 in holes provided respectively in wheels 2 and 4. Since spring 6 is housed between wheels 22 and pinion 14, it is not necessary for ends 28 and 30 to be forced into the corresponding holes since spring 6 is positioned axially by pinion 14 and the base 32 supporting wheel 22.

At a first end, shaft 12 has a pivot 34 mounted in a bearing 36 in a conventional manner. On the side of plate 38, shaft 12 and cylindrical portion 20 which surrounds it pass through plate 38 to allow arrangement of a disc or plate 40 attached to wheel 4 and of a hand 42 attached to wheel 2, hand 42 being situated above disc 40 which is arranged in an opening of dial 44. Hands 45 used to display the time are arranged so as to rotate above hand 42.

Figure 3:
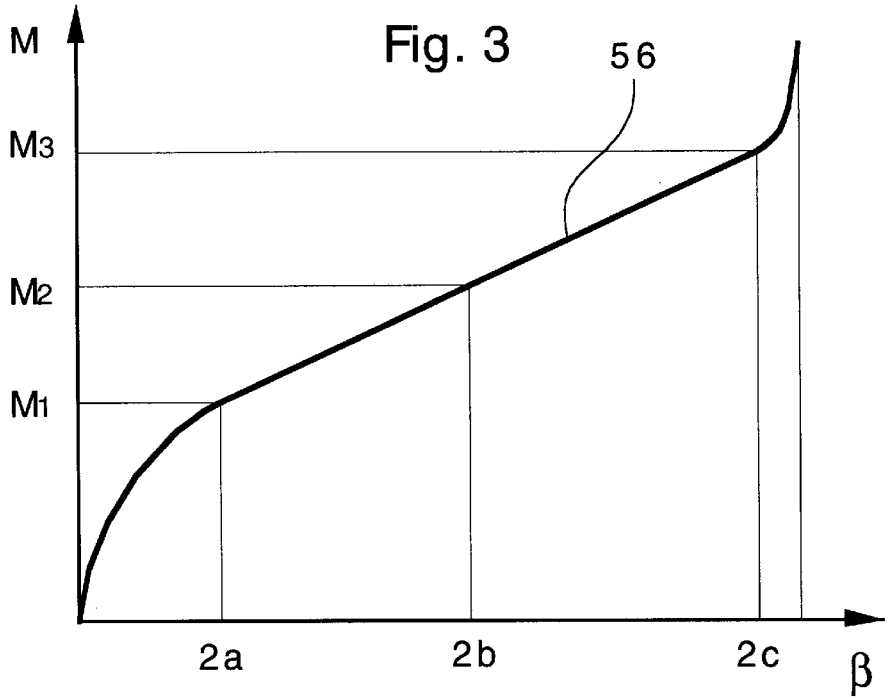
FIG. 3 shows a diagram of the moment of force exerted by the barrel on the pinion directly engaging therewith as a function of the winding level of the mainspring.
Figure 4:
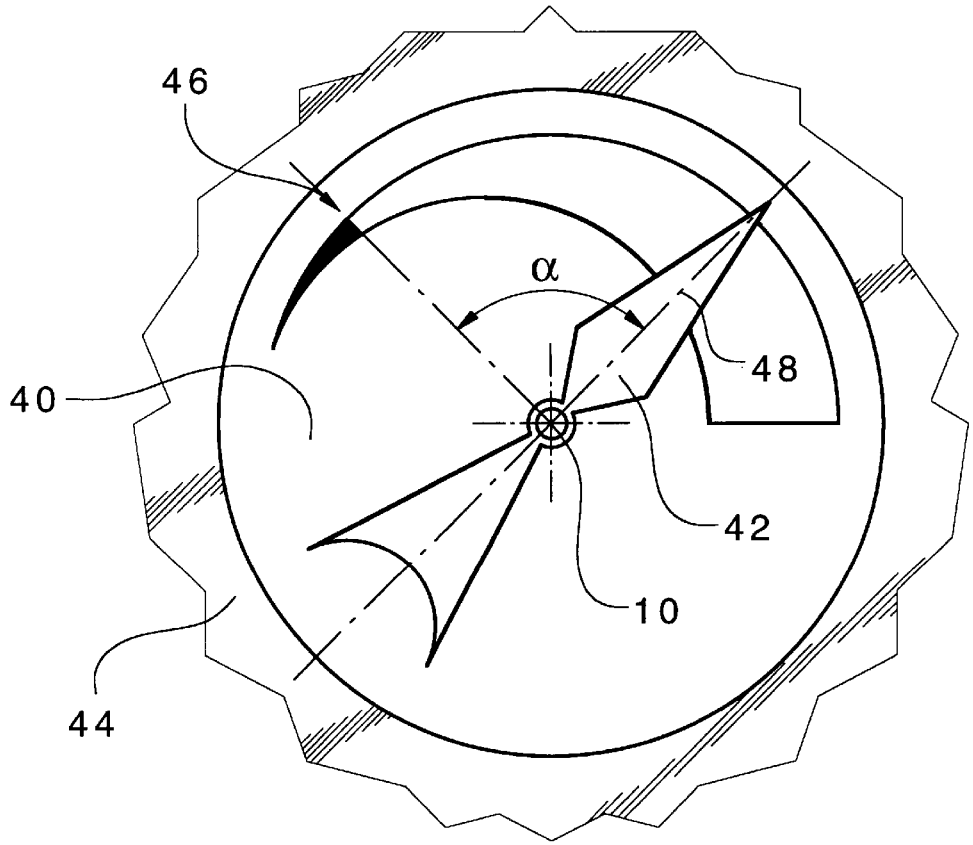
FIG. 4 is a partial top view of the first embodiment in which the display means of the power reserve indicating device are shown.
Figure 5:
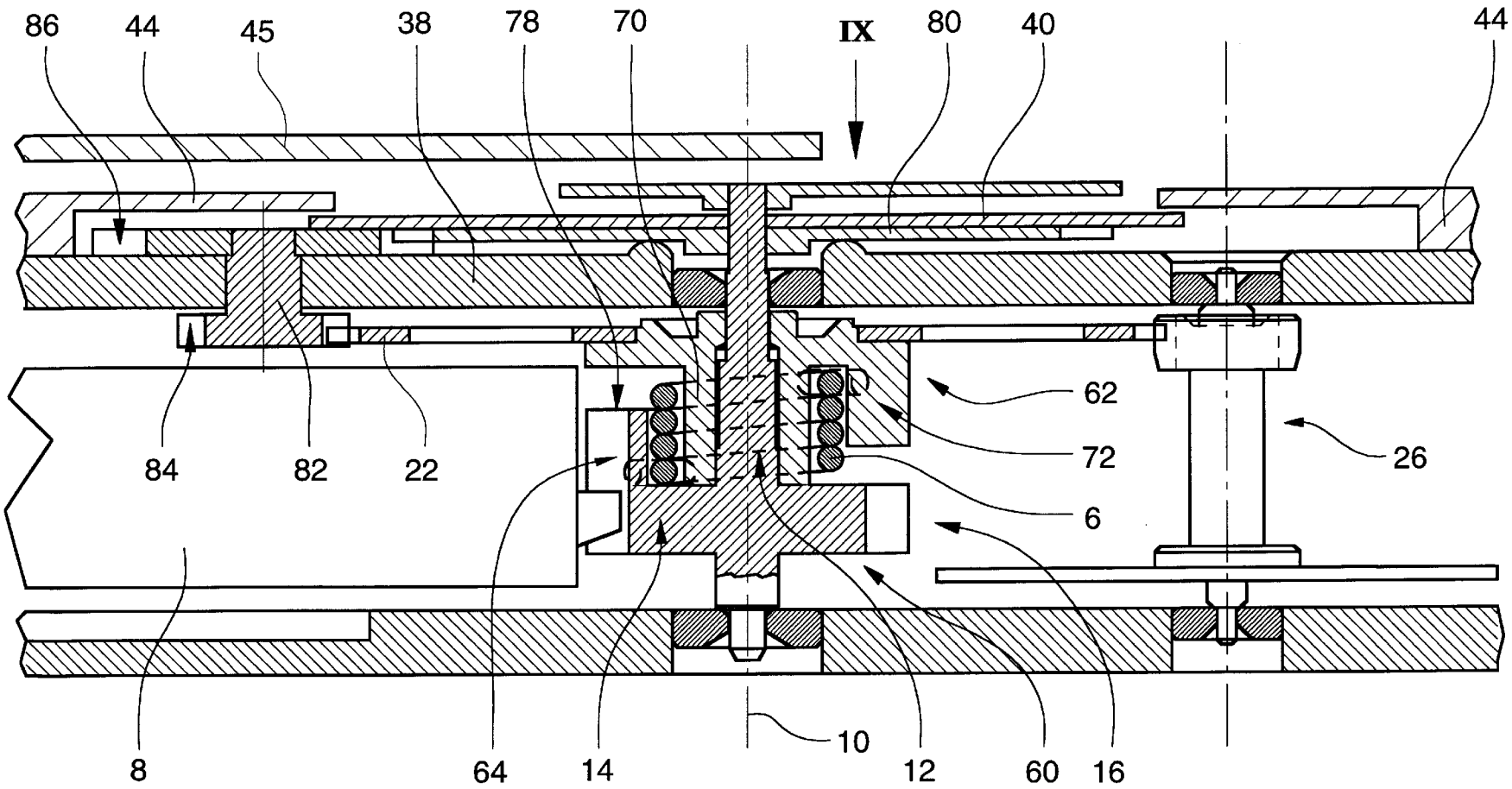
FIG. 5 is a cross-section of a second embodiment of a power reserve indicating device of the invention.
Figure 7:
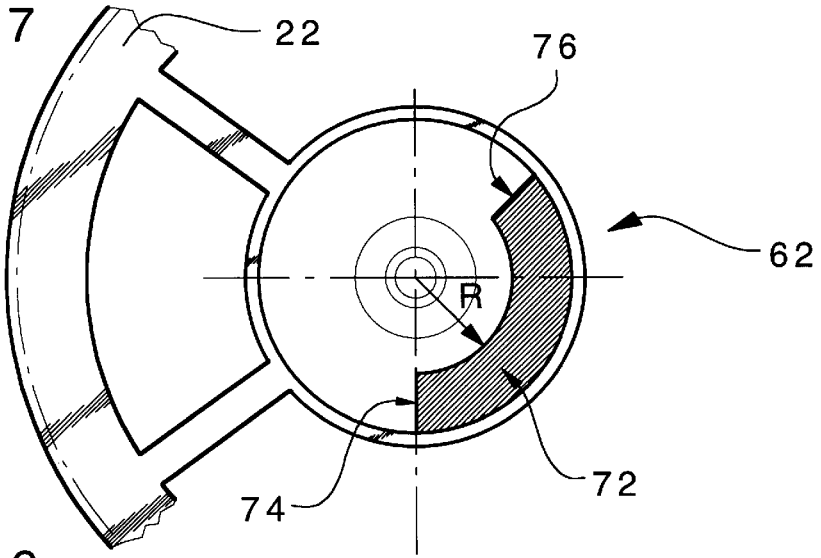
FIGS. 7 and 8 are respectively two elevation views of the two wheels shown in FIG. 6 along projection directions VII and VIII of this Figure.
Figure 6:
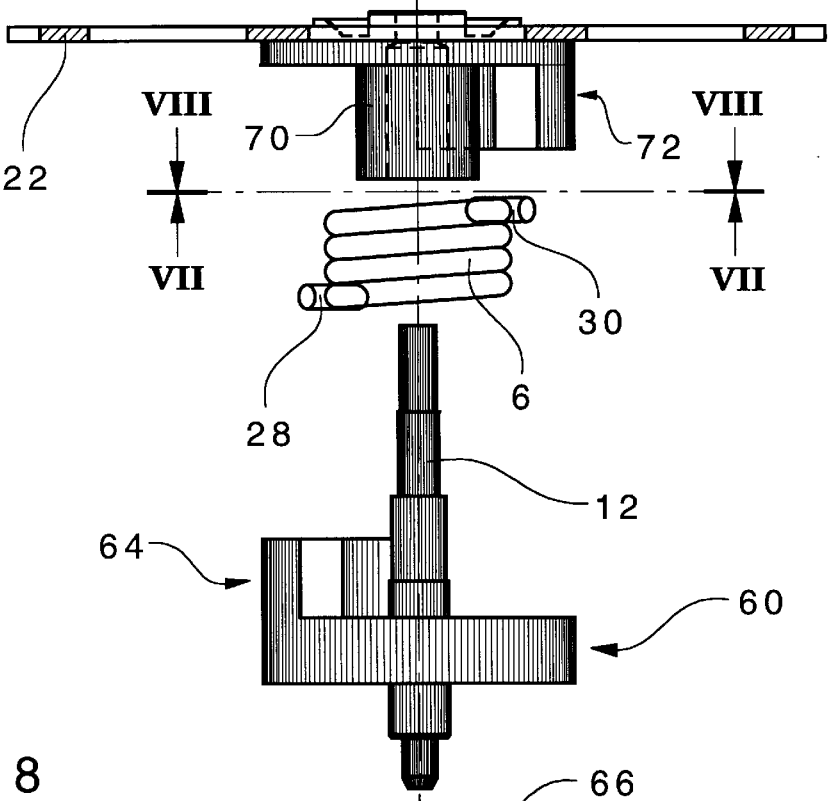
FIG. 6 is an exploded side view of a spring rotatively coupling in a mechanical manner two wheels according to the second embodiment of the power reserve indicating device of the invention.
Figure 8:
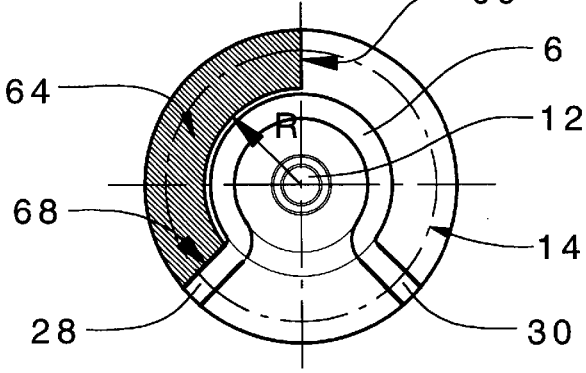

Disc 40 and hand 42 shown from above in FIG. 4 act as power reserve display means. At least one reference mark 46 is shown on disc 40 allowing an angular displacement α to be defined between the direction defined by such mark 46 and geometric axis of rotation 10 and the direction of longitudinal axis 48 of hand 42. Angular displacement α gives an indication of the power reserve of the mechanism driven by barrel 8, as will be described in more detail hereinafter with reference to FIGS. 2 and 3.

In order to limit angular displacement α within a range of determined values, the portion of cylinder 20 situated in the vicinity of pinion 14 is open laterally so as to define a first surface 50 and a second surface 52 forming stops for a pin 54 projecting from pinion 14 in the direction of wheel 4. Thus, the angular displacement is limited downwards by stop 50 and upwards by stop 52.

Figure 2A:
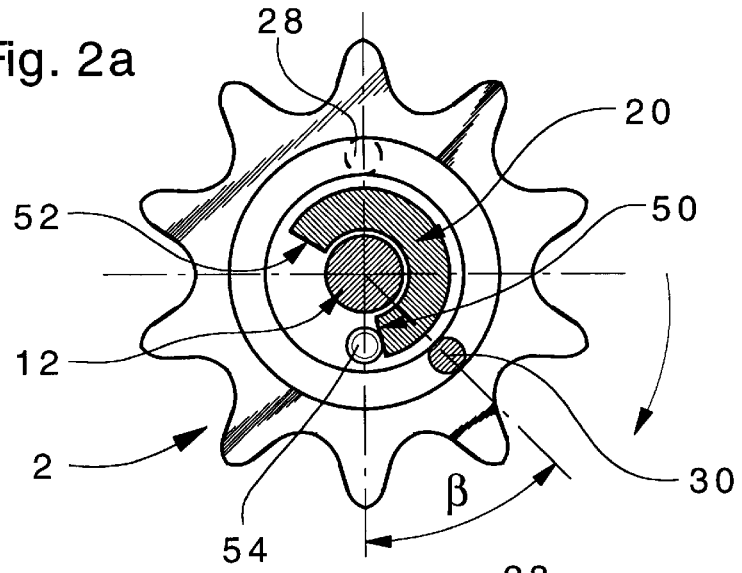

As is shown in FIG. 3, the limitation of angular displacement a corresponds to a limitation of the moment of force exerted by barrel 8 on spring 6. Curve 56, which represents moment of force M as a function of angular displacement β defined by the angle at centre of the two ends 28 and 30 of spring 6, is steadily increasing. When pin 54 abuts stop 50, as is shown in FIG. 2*a,* angle β has the value 2a which corresponds to a minimum moment of force M1 exerted by the barrel on spring 6.

Figure 2B:
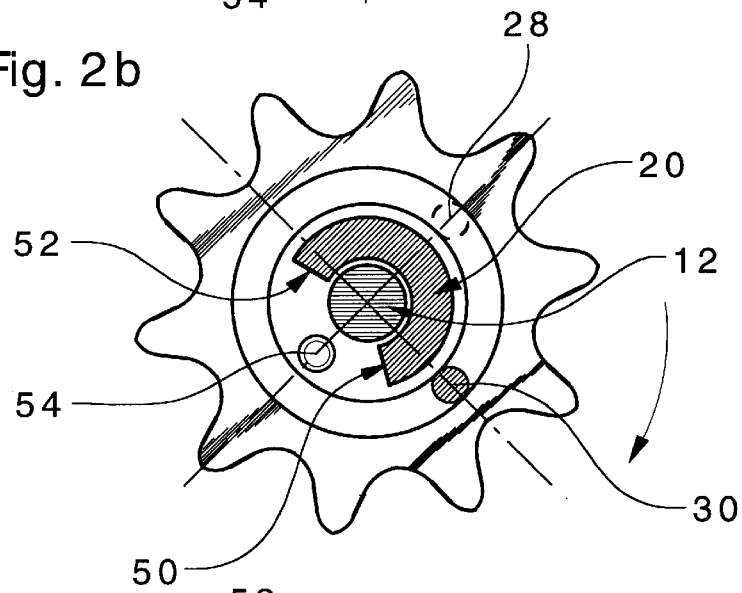
Figure 2C:
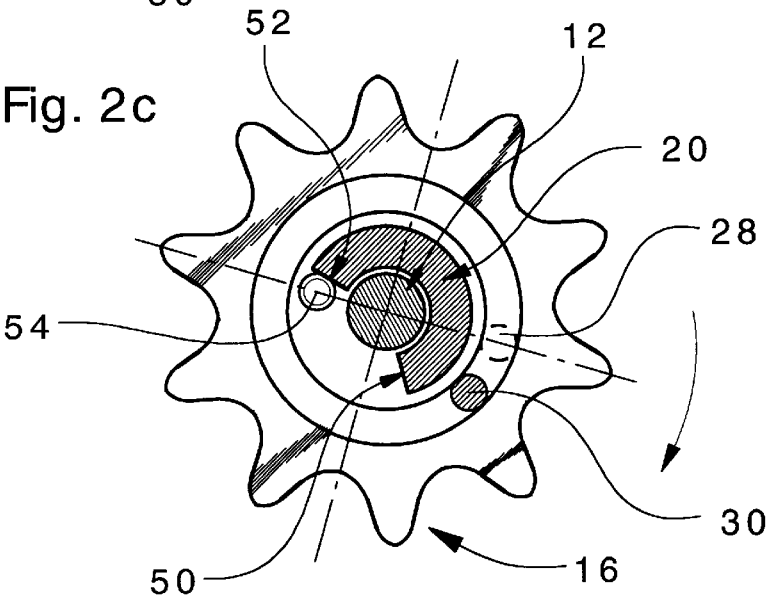

When the moment of force exerted by the barrel on spring 6 is greater than value M1, angle β increases in a substantially linear manner. FIG. 2 shows the relative position of pin 54 with respect to cylinder 20, shown in cross section, corresponding to a moment of force M2 greater than M1 and to value 2b for angle β. Given that curve 56 is steadily increasing, it will be noted that a single determined value of angle β corresponds to each given value of moment of force M.

Finally, when the moment of force exerted on the spring is equal to M3, pin 54 abuts stop 52, this value M3 thus defining a maximum value for the moment of force exerted on the spring. Angle β can thus vary between value 2a and value 2c. Since pin 54 is rotatively coupled to wheel 2 and since end 30 of spring 6 is rotatively coupled to wheel 4, angular displacement α between mark 46 and shaft 48 of hand 42 is equal to angle β decreased or increased by a predetermined constant value.

Angular displacement a is limited downwards by pin 54 and surface 50 of cylinder 20. Likewise, angular displacement α is limited upwards by means of pin 54 and surface 52 of cylinder 20. The minimum displacement value α corresponds to β=2a whereas the maximum displacement value α corresponds to β=2c. Thus, displacement α gives a good indication of the power reserve of the timepiece mechanism according to the invention given that it gives an indication of the moment of force exerted by the barrel on wheel 2, this moment of force having a value dependent on the winding level, i.e. the tension of the mainspring of the barrel acting as mechanical energy accumulator.

It will be noted that wheels 2 and 4 form part of the conventional gear train of the clockwork mechanism driven by barrel 8. Consequently, the power reserve indicating device may easily be integrated within the various existing mechanical clockwork movements. The space required by the power reserve indicating device according to the invention is virtually nil as regards the clockwork movement, only the power reserve display means provided in the vicinity of the dial require a certain amount of space given that disc 40 and hand 42 are both driven in rotation.

In order to limit the height increase of the timepiece, disc 40 is arranged in an opening in dial 44. Consequently, the present invention does not generate a height increase in the timepiece relative to conventional power reserves. It will be noted here that the upper and lower limiting means of angular displacement α are advantageous and constitute a preferred alternative embodiment, but are not necessary for the power reserve indication according to the invention. However, these means for limiting angular displacement a constitute an improvement of the invention allowing spring 6 to be spared by limiting the moment of force exerted thereon and also allowing a certain linearity to be assured between the mainspring tension level and angular displacement α within the predetermined range of accessible values.

In an alternative embodiment, spring 6 is a spiral coiled spring. A spring of this type has the advantage of being flat and consequently of small height, which may be an advantage for mechanical movements of small height. In the case of a spiral coiled spring, the transverse cross-section of the wire forming the spring may be either circular or rectangular, when the spring is formed of a metal ribbon rolled around itself in the same way as the mainspring of a barrel.

It will also be noted that the power reserve device may be arranged in the vicinity of wheels intervening downstream in the gear train driven by barrel 8 with respect to the latter. Thus pinion 14 does not necessarily directly engage with toothing 18 of barrel 8. By way of example, the power reserve device according to the invention may be arranged in the vicinity of wheel 26, which will have to be transformed according to the invention into two coaxial wheels in a similar manner to wheels 2 and 4 of the first embodiment described with reference to FIGS. 1 to 4.

It will further be noted that the lateral opening made in cylinder 20 is preferably less than 180°, which limits the variation of angular displacement α to a value less than 180°. In this case, the angle at centre defined by surface 50 and the direction given by end 30 of spring 6 and geometric axis 10, in a plane perpendicular to said geometric axis 10, is, in an advantageous manner, between −70° and +70°, surface 50 defining the minimum winding position of spring 6. Consequently, the holding in place of wheel 4 is guaranteed. By way of example, the angle at centre defined by surfaces 50 and 52 is between 120° and 150°.

However, given the forces present being exerted on cylinder 20, the lateral opening may be greater than 180° as long as end 30 of spring 6 is carefully fixed to wheel 4 so as to assure that the reaction force exerted by shaft 12 on cylinder 20 is oriented towards the solid portion of the laterally open cylinder.

With reference to FIGS. 5 to 9, a second embodiment of the timepiece according to the invention will be described hereinafter. The elements already described in the first embodiment will not be described again here in detail.

The power reserve indicating device again includes wheels 60 and 62 arranged to rotate about a geometric axis 10 common to both wheels 60 and 62. Wheel 60 meshes with barrel 8 and is rotatively coupled to wheel 62 via a helical spring 6. Wheel 60 differs from wheel 2 in that the portion projecting from pinion 14 towards wheel 62 is formed by a projecting part 64 in the shape of an annular section defining at its two ends two flat surfaces 66 and 68. Wheel 62 differs from wheel 4 in that it is formed of a cylinder 70 which has no lateral opening and which does not pass through plate 38 as in the first embodiment. Moreover, wheel 62 includes a projecting part 72 in the shape of an annular section which extends in the direction of wheel 60 in the same manner as projecting part 64. Projecting part 72 also defines at its two ends two flat surfaces 74 and 76. Internal radius R defined by projecting parts 64 and 72 is greater than the radius defined by spring 6 relative to geometric axis 10.

Figure 9:
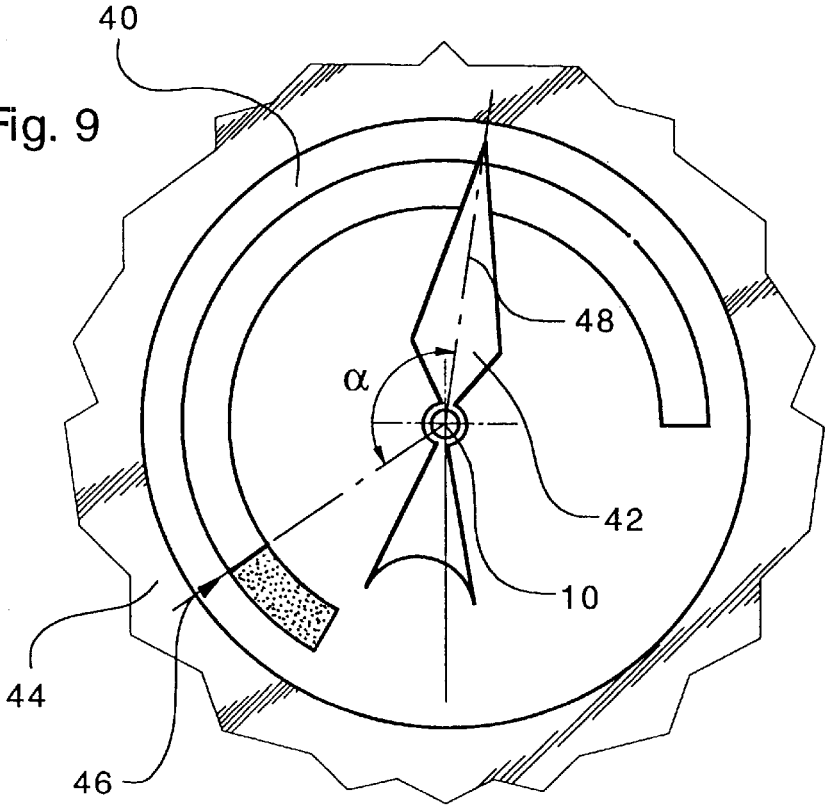
FIG. 9 is top view of the second embodiment according to FIG. 5 in which only the power reserve indicating device display means are shown.

Spring 6 is arranged around cylindrical part 70 of wheel 62. Wheels 60 and 62 are mounted coaxially so that surface 74 can abut surface 66 and that surface 76 can abut surface 68 so as to limit angular displacement $\alpha$ upwards and downwards of the power reserve display as is shown in FIG. 9. The arrangement of projecting parts 64 and 72 is such that the moment of force exerted on spring 6 varies substantially between a value M1 and a value M3 as shown in FIG. 3 within the scope of the description of the first embodiment.

Ends 28 and 30 of spring 6 are bent radially but not axially as in the first embodiment. Moreover, end 28 is arranged so as to abut surface 68 of projecting part 64 and end 30 is arranged so as to abut surface 76 of projecting part 72. In order to avoid end 30 coming between surface 68 and surface 76 when these two surfaces come close to each other, end 30 is situated axially at a higher level relative to upper surface 78 of projecting part 64. It will be noted that, in FIGS. 6 and 8, toothing 16 of pinion 14 has not been explicitly shown, but is represented by a broken circle.

Next, in this second embodiment, plate or disc 40 of the display means is arranged on a toothed wheel 80 rotatively coupled to toothed wheel 22 of wheel 62, toothed wheel 80 being rotatively coupled to toothed wheel 22 via a pinion 82 having a first lower toothing 84 which meshes with wheel 22 and a second upper toothing 86 which meshes with toothed wheel 80. Dual toothing pinion 82 acts as rotation multiplier so that angular displacement $\alpha$ between longitudinal axis 48 of hand 42 and mark 46 provided on the surface of disc 40 may vary between two limit values, namely a minimum value and a maximum value, the difference between which is greater than the relative possible travel for wheel 62 relative to wheel 60. In other words, the maximum angle at centre between surface 68 of projecting part 64 and surface 76 of projecting part 72 is less than the angular difference between the maximum value of angular displacement $\alpha$ displayed by display means 40 and 42 shown in FIG. 9.

Pinion 82 is masked by means of dial 44 and disc 40. It will be noted that the presence of toothed wheel 80 materially separated from disc 40 is not compulsory. Indeed, in an alternative, plate 40 itself includes at its circumference, a toothing meshing with upper toothing 86 of pinion 82. It will also be noted that spring 6 is perfectly housed between wheels 60 and 62. Moreover, its angular positioning is assured by the fact that ends 28 and 30 of said spring 6 constantly abut respective surfaces 68 and 76 against which they are arranged given that spring 6 is constantly subjected to a non zero moment of force.

Figure 10:
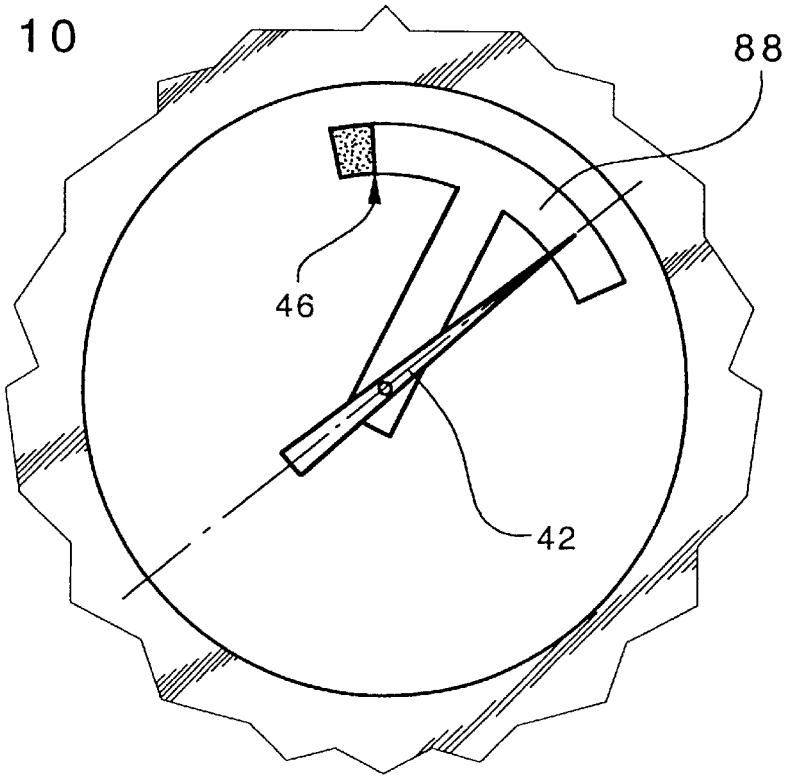
FIG. 10 is an alternative embodiment of the display means.

As regards the display means of angular displacement $\alpha$ representing the tension level of the mainspring of the barrel and thus the power reserve, it will be noted that several embodiments are possible and may be envisaged by the man skilled in the art. An alternative has been shown in FIG. 10. FIG. 10 shows a hand 42 and an element 88 having the shape of an anchor or a T with a circular transverse bar 90. A scale defining at least one mark 46, allowing an angular displacement with hand 42 to be defined, is provided on bar 90. If necessary, it is possible to provide only two hands defining two directions displaced angularly by an angle which varies as a function of the moment of force exerted on spring 6. The arrangement of these two hands may be provided so that, when said two hands are superposed, the user of the timepiece according to the invention is informed of the fact that the moment of force exerted by barrel 8 has become insufficient for the mechanism which it drives to operate properly.

One may also provide two discs, the upper disc having an aperture or opening at its periphery allowing a user to know for example whether the power reserve is low or whether the moment of force exerted by the barrel on the gear train has become too low for the mechanism driven by the barrel to operate properly. One may also provide two plates having different shapes the superposition of which defines a design which evolves as a function of the angular displacement between the two plates.

It will also be noted that the man skilled in the art may provide an arrangement in which the display means associated with the two wheels connected in a resilient manner by spring 6 are situated substantially in a single same plane. Such an alternative, although of more difficult design, allows the height necessary for the display means indicating the power reserve or the mainspring tension level to be reduced.

What is claimed is:

1. A timepiece including a barrel, used for storing the mechanical energy for driving a mechanism, and a device for indicating the power reserve of said mechanism, wherein said power reserve indicating device comprises a resilient element rotatively coupling in a mechanical manner first and second wheels rotatively driven by said barrel about a common geometric axis, and first and second display means rotatively coupled to said first and second wheels respectively and arranged so as to indicate an angular displacement between two directions determined respectively by said first and second display means, at least within a determined range of values of said angular displacement.

2. A timepiece according to claim 1, wherein said resilient element is formed of a helical spring.

3. A timepiece according to claim 1, wherein said resilient element is formed of a spiral coiled spring.

4. A timepiece according to claim 1, wherein said first and second wheels are first and second toothed wheels of a gear train of said mechanism.

5. A timepiece according to claim 4, wherein said first toothed wheel is a pinion directly engaging with said barrel.

6. A timepiece according to claim 1, wherein one of said first and second display means is formed of a disk having on its surface at least a reference mark and the other of said first and second display means is formed of a hand defining an axis indicating said angular displacement with respect to said reference mark.

7. A timepiece according to claim 1, wherein said power reserve indicating device includes first means for limiting said angular displacement so as to provide an upper limit to the moment of force exerted on said resilient element by said barrel.

8. A timepiece according to claim 1, wherein said power reserve indicating device includes second means for limiting said angular displacement so as to provide a lower limit for the moment of force exerted on said resilient element by said barrel.

9. A timepiece according to claim 7, wherein said first angular displacement limiting means comprise a projecting part fixed to one of said first and second wheels and a stop fixed to the other of said first and second wheels and arranged so that said projecting part abuts against said stop when said moment of force reaches a given maximum value.

10. A timepiece according to claim 8, wherein said second means comprise a projecting part fixed to one of said first and second wheels and a stop fixed to the other of said first and second wheels and arranged so that said projecting part abuts against said stop when said moment of force reaches a given minimum value.

* * * * *